US008631922B2

(12) United States Patent
Stone et al.

(10) Patent No.: US 8,631,922 B2
(45) Date of Patent: Jan. 21, 2014

(54) SYSTEM, APPARATUS, AND METHOD FOR OBJECT EDGE DETECTION

(75) Inventors: Robert L. Stone, Perry Hall, MD (US); Mohammed T. Islam, Ellicott City, MD (US); Omid Athari, Cockeysville, MD (US)

(73) Assignee: Sick, Inc., Minneapolis, MN (US)

( * ) Notice: Subject to any disclaimer, the term of this patent is extended or adjusted under 35 U.S.C. 154(b) by 468 days.

(21) Appl. No.: 12/875,307

(22) Filed: Sep. 3, 2010

(65) Prior Publication Data

US 2011/0192703 A1 Aug. 11, 2011

Related U.S. Application Data

(60) Provisional application No. 61/302,948, filed on Feb. 9, 2010.

(51) Int. Cl.
*B65G 43/00* (2006.01)
*G06M 7/06* (2006.01)

(52) U.S. Cl.
USPC ..... 198/340; 271/258.01; 382/101; 382/100; 382/102

(58) Field of Classification Search
None
See application file for complete search history.

(56) References Cited

U.S. PATENT DOCUMENTS

| | | | | |
|---|---|---|---|---|
| 4,360,108 | A | 11/1982 | Logothetis | |
| 4,516,264 | A | 5/1985 | Corvari et al. | |
| 4,733,226 | A | 3/1988 | Kasuya et al. | |
| 5,174,562 | A * | 12/1992 | Mizunaga et al. | 271/261 |
| 5,565,627 | A | 10/1996 | Dorr | |
| 5,727,692 | A | 3/1998 | Large et al. | |
| 5,984,303 | A * | 11/1999 | Oohara et al. | 271/262 |
| 6,421,451 | B1 | 7/2002 | Shiratsuchi et al. | |
| 6,761,352 | B2 | 7/2004 | Scicluna et al. | |
| 7,025,348 | B2 | 4/2006 | Phinney et al. | |
| 7,357,027 | B2 | 4/2008 | Haque et al. | |
| 7,446,278 | B2 | 11/2008 | Fesquet et al. | |
| 7,835,540 | B2 * | 11/2010 | Philippe et al. | 382/101 |
| 2002/0096299 | A1 | 7/2002 | Mukai | |
| 2007/0018383 | A1 | 1/2007 | Ohara et al. | |
| 2009/0243203 | A1 | 10/2009 | Yokoyama et al. | |

FOREIGN PATENT DOCUMENTS

| | | | |
|---|---|---|---|
| DE | 10 2008 007 010 | A1 | 9/2008 |
| EP | 1 542 173 | A1 | 6/2005 |
| EP | 1 584 586 | A2 | 10/2005 |
| FR | 2685650 | | 7/1993 |

* cited by examiner

*Primary Examiner* — Kavel Singh
(74) *Attorney, Agent, or Firm* — Miles & Stockbridge P.C.

(57) ABSTRACT

A system, apparatus, and method for detecting overlapped items in a sequence of items moving along a conveying path based on rigidity and thickness contour measurements.

9 Claims, 9 Drawing Sheets

SYSTEM, APPARATUS, AND METHOD FOR OBJECT EDGE DETECTION

CROSS-REFERENCE TO RELATED APPLICATIONS

This application claims the benefit of provisional U.S. Application No. 61/302,948, filed Feb. 9, 2010, the entire content of which is incorporated by reference in its entirety herein.

FIELD OF THE INVENTION

The present invention relates generally to handling of items, and, more particularly, to systems, apparatuses, methods, and computer program products for detecting overlapped mail items while they are being transferred.

BACKGROUND

In a mail sorting system, the mail pieces to be sorted are essentially flat rectangular objects arranged together with their planar surfaces along a common axis to form a stack. A feeder mechanism picks off individual mail pieces from an input stack to an optical reader which reads the address printed on the mail piece and directs the mail piece to one of several output stacks corresponding to the destination address. In the mail handling apparatus, the mail items should be transferred individually. However, due to the high feed rate or diverse product shape (length, width, height, and thickness) and composition (material, form), the rate of overlapped (double feed) mail transfer can also be high. When a plurality of mail items are transferred in an overlapped manner to the handling apparatus, the handling apparatus cannot perform its normal operation.

Currently available double feed detection systems are either expensive and require complex setups (for example, digital cameras that analyze digital images of the passing items), or are unreliable because they are limited to detecting items that have specific shapes, colors, thicknesses, are of a particular type and are not fully overlapped with each other, or cannot accurately detect more than two overlapped items. These limitations increase the number of undetected overlapped items as well as the number of incorrectly (unwarranted) rejected items. Therefore, it would be advantageous to have a detection system, apparatus, and method that accurately detects mail characteristics, including edges, as early as possible in the feed path, in order to determine conditions, such as double feed (overlap of one or more mail pieces).

SUMMARY OF THE INVENTION

Embodiments are directed generally to systems, apparatuses, methods and computer program products for detecting various features, focused primarily on the edge, but also features such as rigidity, thickness, etc., in order to determine mail conditions. One exemplary condition is double feeds of items, such as, but not limited to, pieces of mail (letter mail, mixed mail), flats, and other postal items, or other similar shape objects such as shingles or plates.

In various embodiments, the systems, apparatuses, methods and computer program products include means for detecting the presence of two or more overlapped items passing simultaneously in a stream of items through a sorting and handling apparatus.

Various embodiments can include systems, apparatuses, methods, and computer program products for detecting multiple overlapped items with a low proportion of unwarranted or incorrect rejects.

In various embodiments, a double feed can include two or more items stuck together along their flat sides with either one or more edges completely or partially overlapped. A double feed can include two or more overlapped items having different heights, colors, widths, and thicknesses (particularly very thin or post card like objects).

In various embodiments, the system can include means for detecting overlapped items in a sequence of items, where the items have at least one of their edges exposed for viewing as they pass along the feed path.

In various embodiments, the system can include means for separating the overlapped items so as to not be fully overlapped by shifting the position of the overlapped items relative to each other. In various embodiments, this shift can be accomplished by including a transition section in the conveyance path along which the items are transported. The transition section can include, but is not limited to, a bent section, an edge section, and/or a curved section of the conveyance path, a reverse conveyance, or a vacuum assisted section.

In various embodiments, the system can include means for transporting items (single and/or overlapped) in a sequence along a feed path of an item sorting and handling apparatus, means for measuring the thickness of the item at a plurality of points along the length of the item as it passes through a detection area, an outline extraction means for generating a thickness outline (contour) from the data representing the different thicknesses (thickness variations) measured along the length of the item, and processing means for analyzing the extracted thickness contour to determine a double feed condition (two or more overlapped items) based on the outline.

In particular, in various embodiments, the processing means analyzes the data representing the thickness contour to determine the transition edges between areas of different thicknesses.

In particular, in various embodiments, the processing means calculates the levels between the edges (step changes or rate changes) to provide discrete levels of thicknesses, compares the height of each step change with a preset minimum value, and determines whether the item is a single item or two or more overlapped items, or compares the rate of change of a height and determines whether the item is a single or two or more overlapped items, based on the comparison.

In particular, in various embodiments, the processing means determines whether two or more items are overlapped when the step change is greater than the preset minimum value. The minimum value can be set depending on the specific application, and is based on numerous factors, such as, but not limited to, the type of item detected, the accuracy of the thickness and other detectors used in the system as well as the different variables of the item sorting and handling apparatus.

In various embodiments, the double feed detection system further includes shifting overlapped items relative to each other by using a transition section, such as, but not limited to, a bent portion, a curved portion, and/or an edge portion, in the feed path. The overlapped items are caused to move apart relative to each other during movement of the items through the transition section.

In various embodiments, the detection system further includes means for measuring the rigidity of the item at a predetermined position of the transition section. In particular, the rigidity of the item can be measured based on the deflection of the item passing through the transition portion and the geometry of the transition section.

In various embodiments, the detection system further includes processing means to determine whether a double feed condition is present based on a combination of rigidity and thickness measurements.

BRIEF DESCRIPTION OF THE DRAWINGS

The drawings described herein are for illustration purposes only and are not intended to limit the scope of the present disclosure in any way. The invention will be best understood by reading the ensuing specification in conjunction with the drawing figures, in which like elements are designated by like reference numerals. As used herein, various embodiments can mean some or all embodiments.

DETAILED DESCRIPTION

Figure 1:
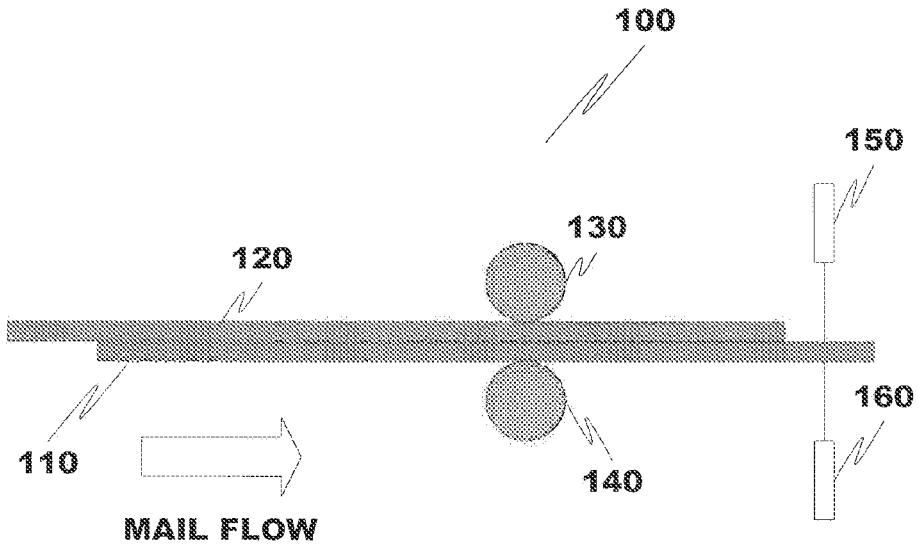
FIG. 1 is a side perspective view of a system according to various embodiments of the invention.
Figure 2:
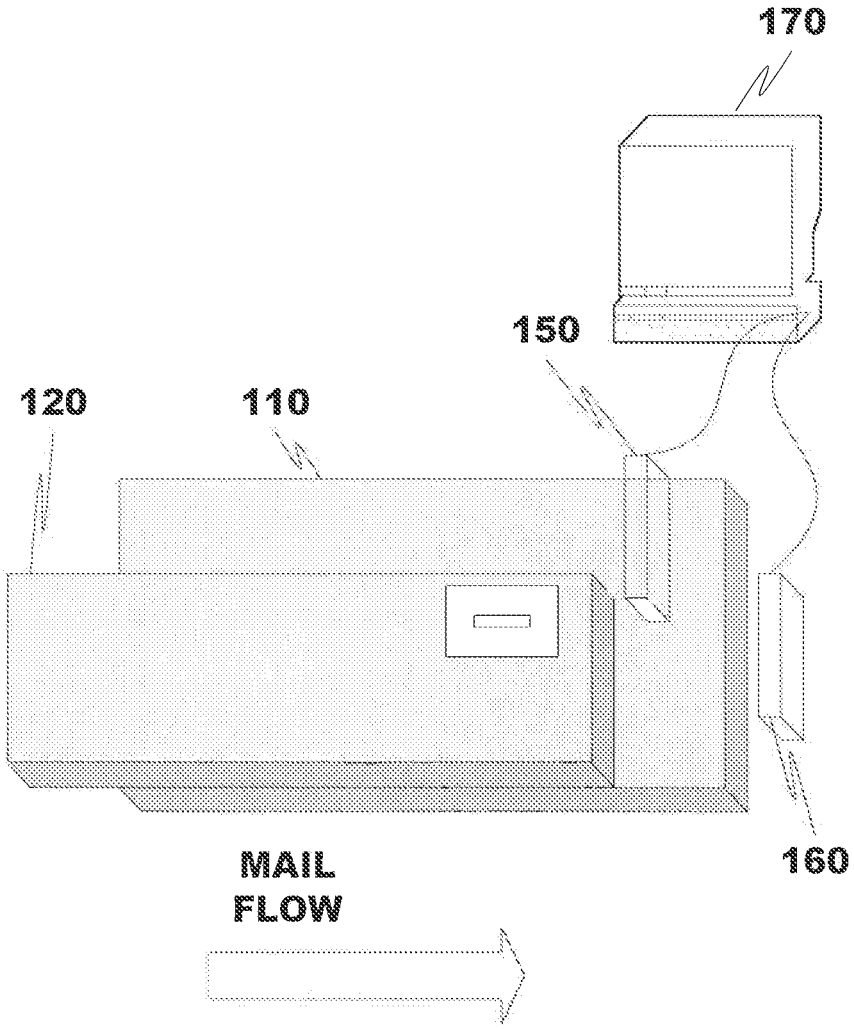
FIG. 2 is a partial plan view of a multiple feed detection system according to various embodiments.
Figure 3:
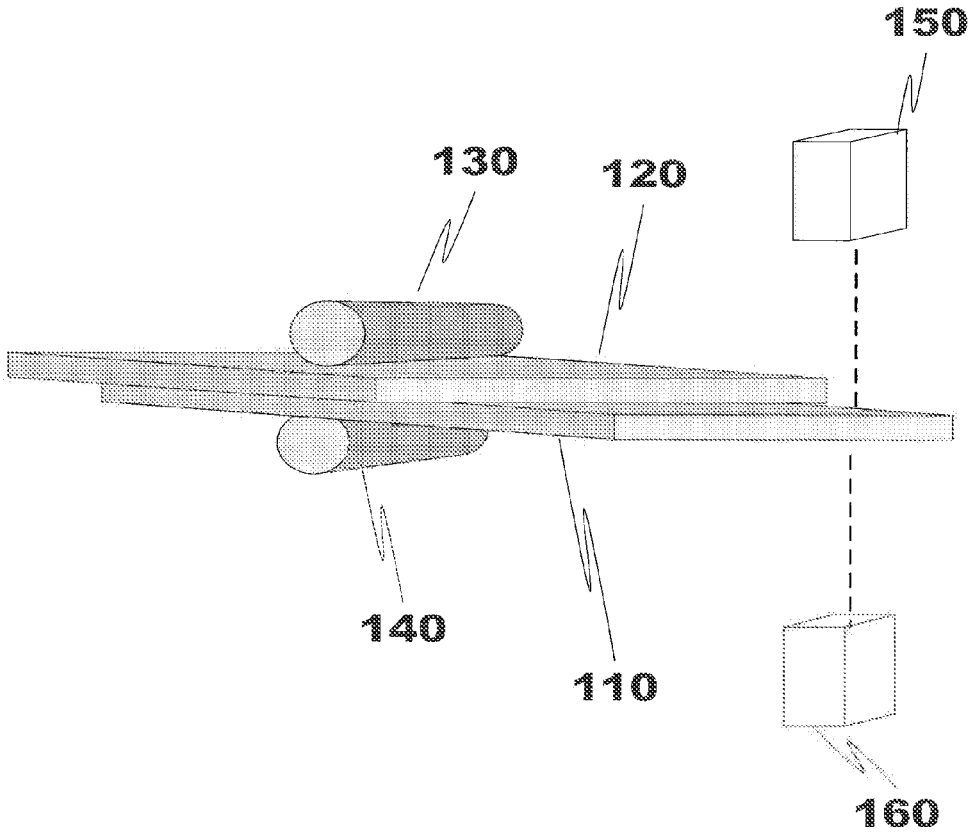
FIG. 3 is a front perspective diagrammatic view of a multiple feed detection system according to various embodiments.

In general, in FIGS. 1-3 a system and method of detecting overlapped items in an item sorting system is disclosed, the system including a detecting device for measuring a thickness of the item at a plurality of locations along a dimension of the item, a processing device configured to detect variations in the measured thickness and to measure differences between the variations, the differences indicating step changes between discrete levels of thicknesses, the processing device being further configured to compare the step changes with a predetermined value (X), and to determine a double feed condition indicative of two or more overlapped items when a step change is greater than the predetermined value (X).

Figure 4:
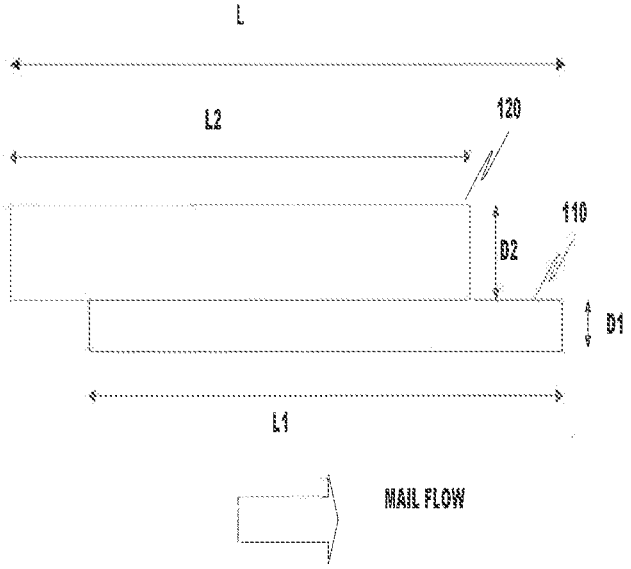
FIGS. 4 and 5 are diagrammatic side views of overlapped mail items according to various embodiments.
Figure 5:
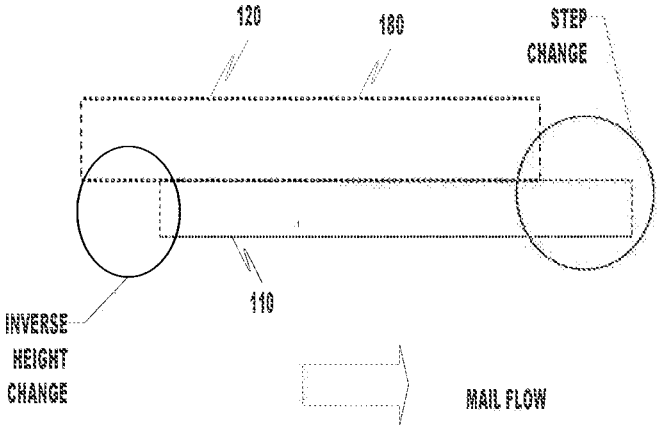

The system 100 shown in FIGS. 1-3 is configured to detect various features, such as, but not limited to, edge, rigidity, thickness, etc., of an item A in order to determine certain conditions of the item A, such as, but no limited to, a double or multiple feeds condition where two or more items 110, 120 are partially or completely overlapped. Item A in FIGS. 1-3 includes two overlapped mail pieces 110, 120 stuck together along their flat sides with one or more edges completely or partially overlapped. However, item A can include any other combination of items, such as, but not limited to, pieces of mail (letter mail, mixed mail), flats, and other postal items, or other similar shaped objects such as, but not limited to, shingles or plates. The overlapped items can have different heights, colors, widths, and/or thicknesses. The overlapped mail pieces 110 and 120 shown in FIGS. 1-3 are moved (transported) simultaneously along a conveyor path (not shown) using rollers 130 and 140, in a direction as indicated by the arrow (mail flow). One or more thickness detectors 150 and 160 can be positioned along the conveyance path in a plane substantially perpendicular to the overlapped mail pieces 110, 120 and having an optical path (light path) in a direction generally perpendicular to the direction of conveyance of the mail pieces 110, 120. Detectors 150 and 160 are configured to continuously measure the thickness of item A (including the overlapped mail pieces 110, 120) by viewing and detecting a single side or both sides of the item A as the item is moved through a detection field of the detectors 150, 160. The data from the thickness detectors 150 and 160 is transmitted to a processing device 170, shown in FIG. 2, which processes and analyzes the data from the detectors 150, 160 and generates an outline (contour) 180 (shown in detail in FIG. 6) of the thickness variations of item A along a dimension of item A which is substantially parallel with the direction of conveyance (i.e., a direction along the length of item A). The total length L of item A depends on the lengths L1 and L2 of the individual mail pieces 110 and 120, respectively, as well as the amount of overlap between them. The processing device 170 is further configured to identify (determine) based on the thickness contour 180 generated, the variations in the measured thickness of item A and to measure the differences between the variations, the differences indicating step changes (D1, D2, etc.) between discrete levels of thickness areas of item A (see FIGS. 4 and 5). The processing device 170 is further configured to calculate the height (S1, S2, S3, etc.) of each of the identified step change. The processing device 170 then compares the calculated height (S1, S2, S3, etc.) of each identified step change with a previously determined value (X) and identifies a double or multiple feed condition (i.e., overlapped mail pieces) when a height Si of a step change Di is greater than the predetermined value (X), and a no double feed condition (no overlapped mail pieces) when a height Si of a step change Di is less than the predetermined value (X). The number of mail pieces 110, 120 stuck to each other corresponds to the number of step changes Di that have a height Si greater than the predetermined value (X). This system and method therefore, allows for the detection of multiple overlapped items irrespective of their individual thicknesses or the total thickness of the overlapped items. The processing device 170 can further determine a rate and/or distance of overlap of the item based on the thickness contour measurements.

The thickness detectors 150, 160 can include any applicable thickness detectors, such as, but not limited to, any optical displacement detectors, laser, infrared or ultrasonic detectors, 2D and 3D camera based detectors, and any mechanical thickness measuring devices.

Figure 6:
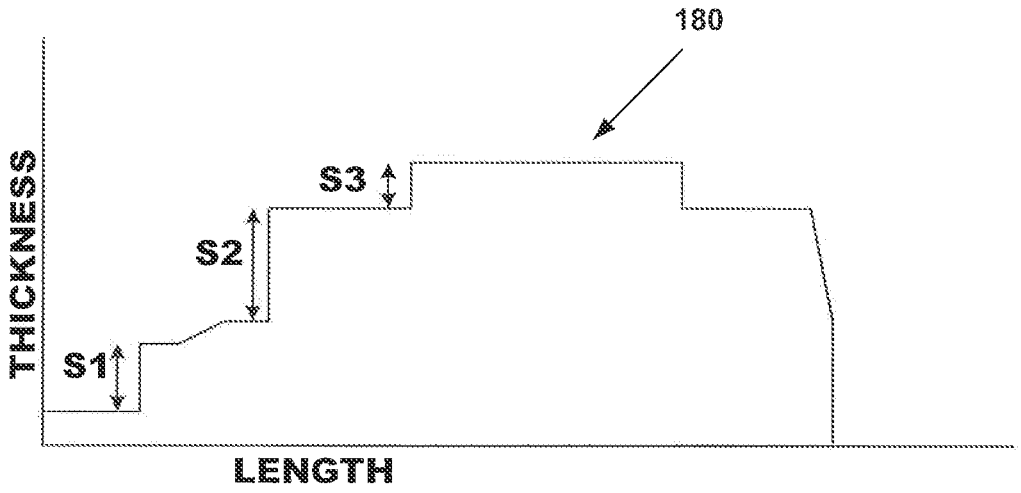
FIG. 6 is a contour map showing thickness variation over a length of the feed.

FIG. 6 shows an exemplary thickness contour 180 generated by the processing device 170 according to an embodiment. The contour shows discrete levels of thicknesses obtained from the measured thicknesses at different points along a length of a mail item A.

Figure 7:
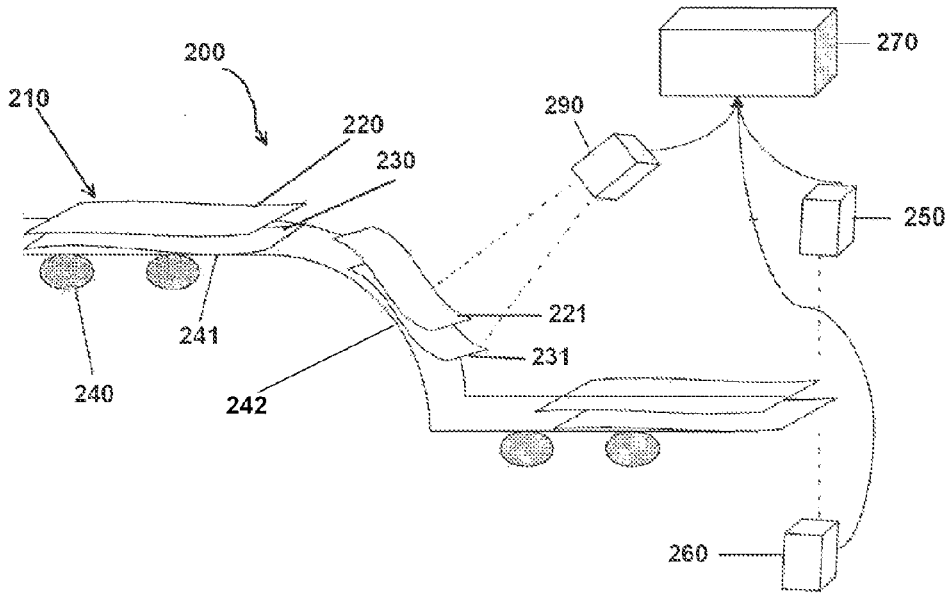
FIG. 7 is a perspective diagrammatic view of a detection system including a transition section and a rigidity detection means according to various embodiments.

With respect to FIG. 7, there is shown a system 200 for detecting overlapped items 210 in a sorting installation. In various embodiments, the item 210 is a mail item including two overlapped mail pieces 220 and 230, for example, moved along a conveyor device or platen 241 using rollers 240 in a mail sorting installation. The conveying path has a transition section 242 which allows one of the mail pieces 220, for example, to move (shift) relative to the other 230, for example, while moving through the transition section 242. This transition section 242 can be a curved section in the conveyor belt, or an edge along the conveyor belt, or any other similar mechanism that allows the mail pieces 220, 230 to bend around the transition section 242 and shift relative to each other. The mail pieces 220, 230 can either separate completely through this movement or separate only partially so as to remain partially overlapped but with their respective leading edges 221, 231 further apart from each other for easier and more accurate viewing and detection. The separated leading edges 221, 231 allow for better recognition of the separations between the multiple thickness areas during the thickness contour generation.

The system 200 includes at least one thickness detector 250, 260, positioned in a plane substantially perpendicular to the item 210 and substantially perpendicular to the conveying path so as to continuously detect the thickness of the item 210 at different positions along the item 210 while it is moved along the conveyance path. The data from the thickness detectors 250, 260 is transmitted to a processing device (processor) 270 which analyzes the data received from the detectors 250, 260 and generates an outline (similarly to the outline shown in FIG. 6, for example) of the thickness variations along a dimension of the item 210 which is parallel with the direction of conveyance (i.e., the length of the item, for example). The processor 270 determines (identifies) areas where the total thickness of the item 210 changes, identifies the transition areas D1, D2 (step changes) between adjacent areas of different thicknesses, and calculates the height (S1, S2, S3, etc.) of each of the identified step change (D1, D2, etc.). The processor 270 then compares the height (S1, S2, S3, etc.) of each identified step change (D1, D2, etc.) with a previously determined and stored value (X) and identifies a double or multiple feed (overlapped items) condition when the height Si of a step change Di is greater than the predetermined value (X). The number of mail pieces stuck to each other (overlapped) corresponds with the number of step changes having a height above the predetermined value.

In various embodiments, at least one rigidity sensor 290 is also added into the system 200 to increase the double feed detection efficiency. The rigidity sensor 290 is positioned adjacent the transition section 242 so as to measure the rigidity of the transferred mail item 210 while the mail item 210 is bent while moving through the transition area 242. The rigidity sensor 290 is configured to measure a deflection of the individual mail pieces 210, 220 relative to the position of the rigidity sensor 290 and determine the rigidity (stiffness) of the mail pieces 210, 220, based on the measured deflections and the geometry (shape, position, etc.) of the transition section 242. Measuring the rigidity of the mail pieces 220, 230 helps to discern whether the mail pieces 220, 230 are overlapped even when the mail pieces 220, 230 have the same length and/or are substantially completely overlapped. When the mail pieces 220, 230 have the same length and/or are completely overlapped, it is harder to discern the two separate leading edges 221, 231 which indicate the step changes between two separate thickness regions. Detecting the rigidity of the individual mail pieces 220, 230 therefore increases the probability of detecting a double (or multiple) feed condition while reducing detection errors.

In the embodiment where both thickness and rigidity detectors are used, the processor 270 is further configured to analyze the data received from the rigidity detector 290 and compare the measured rigidity with a predetermined value (Y). The processor 270 then compares the height (S1, S2, S3, etc.) of each identified step change with the previously determined value (X) and the measured rigidity with a predetermined value (Y), and identifies a double feed condition when the height of a step change is greater than the predetermined value (X) and the rigidity exceeds the predetermined value (Y), and a no double feed condition when the step change and the rigidity do not exceed the respective predetermined values (X) and (Y). This system therefore, allows for the detection of multiple overlapped items irrespective of their individual thicknesses or the total thickness and length of the overlapped item, and thus allows for a more accurate determination of whether multiple mail pieces are overlapped during sorting.

The rigidity and thickness detectors 290, 250, 260 can include any applicable thickness and rigidity detectors, such as, but not limited to, any optical displacement detectors, laser, infrared or ultrasonic detectors, and 2D and 3D camera based detectors. The thickness detector can also include any applicable mechanical thickness detection mechanism.

The system, therefore, allows for the detection of multiple overlapped mail pieces irrespective of their individual thicknesses or the total thickness and length of the overlapped mail piece. The system can be used to detect a condition, such as a double or multiple feed condition of any combination of mail items having different or similar shapes, lengths, widths, and/or thicknesses. The mail items can be, but are not limited to, letters, postcards, and/or flats. The system and method can also be used to detect overlapped items having similar shapes, such as, but not limited to, shingles and plates. The processing device can further determine a rate and/or distance of overlap of the item based on the thickness contour measurements.

Figure 8:
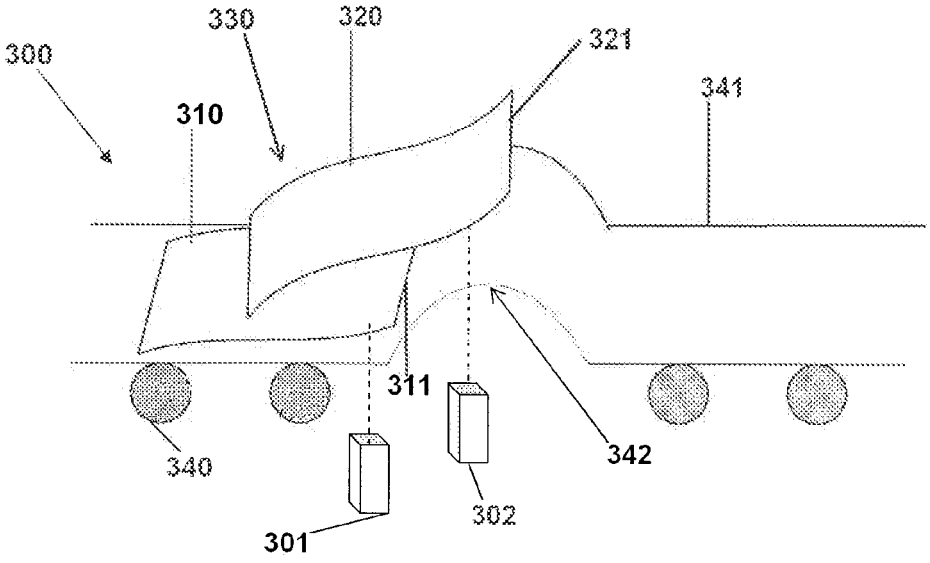
FIG. 8 is perspective diagrammatic view of a detection system illustrating detection on the item to measure edge and/or rigidity according to various embodiments.

With respect to FIG. 8, there is shown a system 300 for detecting overlapped items 330 in an item sorting installation. The item 330 with two overlapped pieces 310 and 320 is moved along a conveyor device or platen 341 using rollers 340. The conveying path has a transition section 342 which allows one of the pieces to move (shift) relative to the other while moving through the transition section 342. The transition section 342 can be a curved section in the conveyor belt, or an edge along the conveyor belt, or any other similar mechanism that allows the pieces 310, 320 to bend or move around the transition section 342 and shift relative to each other. The pieces 310, 320 can either separate completely through this movement or separate only partially so as to remain partially overlapped but with their respective leading edges 311, 321 further apart from each other for easier and more accurate viewing and detection. The separated leading edges 311, 321 allow for better recognition of the separations between the multiple thickness areas during thickness contour generation, for example. The separated leading edges 311, 321 also allow for better recognition of the leading edges during edge detection, for example.

Two detectors (sensors) 301, 302 are positioned adjacent the transition section 342 and are configured to measure the rigidity and/or the thickness of the transferred item 330 and/or to detect the leading edges 311, 321 of the overlapped pieces 310, 320 while the item 330 is bent (shifted) while moving through the transition area 342. Two detectors are shown in FIG. 8. However, only one detector configured to measure the thickness, rigidity and/or detect edges, can also be used. The detectors 301, 302 can detect the rigidity of the item 330 by measuring a deflection of the individual pieces 310, 320 relative to the position of the detectors 301, 302, respectively, and determine the rigidity (stiffness) of the individual pieces 310, 320 based on the measured deflections and the geometry (shape, position, etc.) of the transition section 342. Measuring the rigidity of the item 330 helps discern whether the individual pieces 310, 320 are overlapped even when the pieces 310, 320 have the same length and/or are completely overlapped. When the pieces 310, 320 have the same length and/or are completely overlapped, it is harder to discern two separate leading edges 311, 321 or two separate thickness regions and therefore, detecting the rigidity of the individual pieces 310, 320 of the item 330 increases the probability of detecting a double (multiple) feed condition.

The detectors 301 and 302 can also be configured to measure a thickness of the item 330 at a plurality of positions along the length of the item 330 as it moves through the transition section 342. The data from the detectors 301, 302 can be sent to a processing device (not shown) which then analyzes the data received from the detectors 301, 302 and determines whether there is an item overlap based on the measured rigidity, and/or a thickness contour analysis and/or a leading edge position detection of the individual pieces 310, 320 of the item 330.

In an embodiment where one of the detectors 301, 302 is used as a thickness detector and the other one as a rigidity detector, the processor is configured to analyze the data received from both detectors 301, 302 and combine the measurements to determine whether an overlap condition exists. The processor derives a thickness contour based on the thickness measurement taken at different points along a length of the item 330 while the item is moving through the transition region 342. The processor then identifies locations where variations in the item 330 thickness occur and assign a step change Di to each location where a change in the thickness occurs. The processor then calculates a height (S1, S2, S3, etc.) of all identified step changes Di and compares the height (S1, S2, S3, etc.) of each identified step change with a previously determined value (X). The processor is further configured to compare the measured rigidity using the second detector with a predetermined rigidity value (Y). The processor then identifies a double feed condition when a step change is greater than the predetermined value (X) and the rigidity exceeds the predetermined value (Y), and a no double feed condition when the step change and the rigidity do not exceed the respective predetermined values (X) and (Y). This system therefore, allows for the detection of multiple overlapped items irrespective of their individual thicknesses or the total thickness and length of the overlapped item, and thus allows for a more accurate determination of whether multiple mail pieces are overlapped during sorting. The processing device can further determine a rate and/or distance of overlap of the item based on the thickness contour measurements.

The individual pieces 310, 320 can include any mail items having different or similar shapes, lengths, widths, and/or thicknesses. The mail items can be, but are not limited to, letters, postcards, and/or flats. The system and method can also be used to detect overlapped items having similar shapes, such as, but not limited to, shingles and plates.

The rigidity, thickness and edge detectors 301, 302 can include any applicable thickness, rigidity and edge detectors, such as, but not limited to, any optical displacement detectors, laser, infrared or ultrasonic detectors, and 2D and 3D camera based detectors. The thickness detector can also include any mechanical thickness detectors.

Figure 9A:
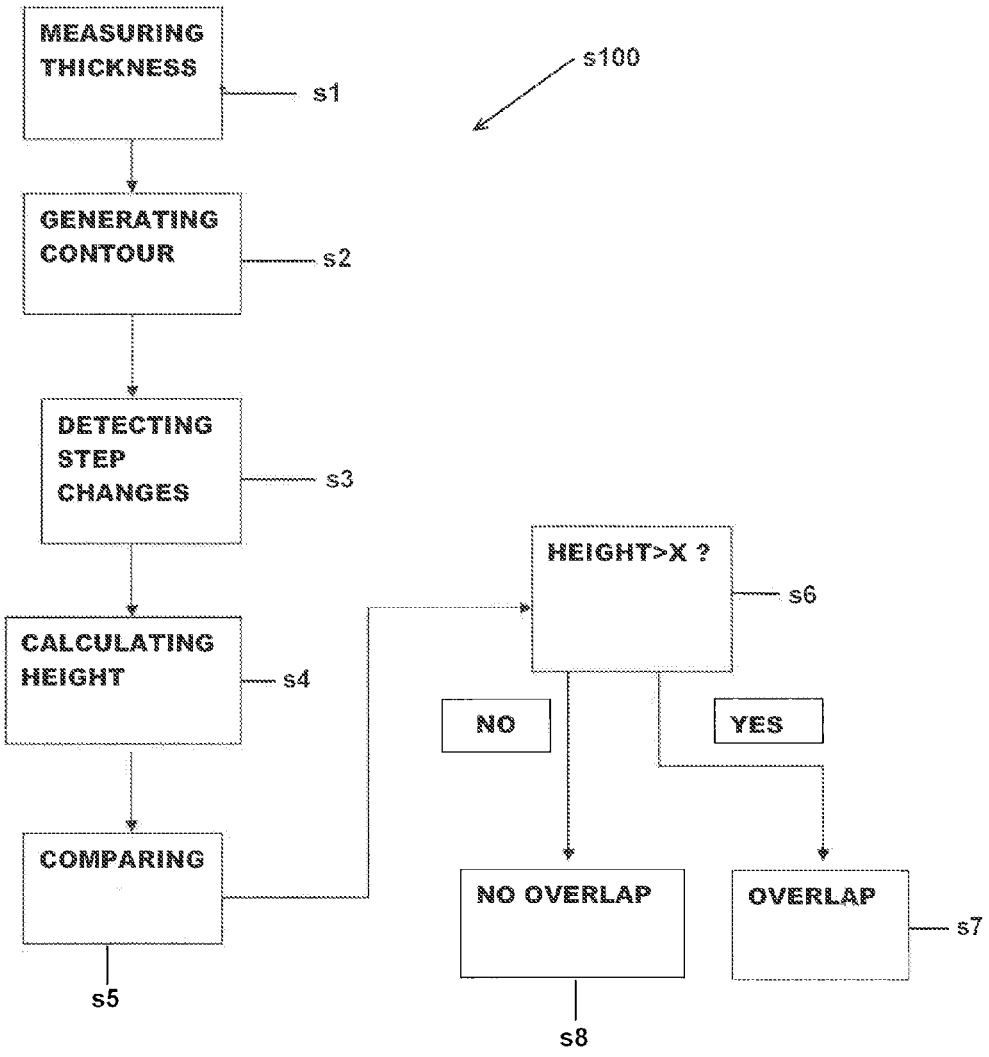
FIGS. 9A and 9B are block diagrams illustrating detection processes according to various embodiments.

In FIG. 9A it is illustrated a detection process s100 that can be applied to detect an item condition, such as, a double or multiple feeds condition (overlapped items) using any of the systems as disclosed in the embodiments of FIGS. 1-8. The process s100 can also be stored in a non-transitory computer readable medium, such as disks, CD-ROMs, etc. and executed using a computer processing system including any software and hardware modules necessary for execution of the process in a particular application. A sequence of programmed instructions is embodied upon the computer-readable storage medium for handling overlapped items in an item sorting system so that when a computer processing system executes the sequence of programmed instructions embodied on the computer-readable storage medium it causes the computer processing system to perform the steps of: measuring a thickness of the item at a plurality of locations along a dimension of the item, detecting variations in the measured thickness, measuring differences between the variations, the differences indicating step changes between discrete levels of thicknesses, comparing the step changes with a predetermined value, and determining a double feed condition indicative of two or more overlapped items when a step change is greater than the predetermined value.

In s1, a detection device is continuously measuring a thickness of an item at various points along a dimension of the moving item (length, for example) while the item being transported (transferred, conveyed) on a conveying device through a detection field of a thickness measuring detector. A thickness contour generation follows in step s2 in which a contour is generated based on the variations in the thickness of the item across its dimension. Based on the generated contour, step changes or locations where there is a change in the thickness of the item are detected in step s3. The height of each of the detected step change is calculated in s4 and the measured heights are compared to a previously set value (X) in s5. Based on the result of the comparison, it is determined in s6 whether the item is an overlapped item and therefore, whether a double or multiple feeds condition exists. If the height of a step change is greater than the predetermined value (X), there is an overlap condition present, namely, the item contains overlapped pieces (s7), whereas if the height of a step change is less than the predetermined value (X), it is concluded that there is no overlap and therefore no double feed condition (s8). The number of step changes having a height greater than the predetermined value (X) represents the number of items which are overlapped.

Figure 9B:
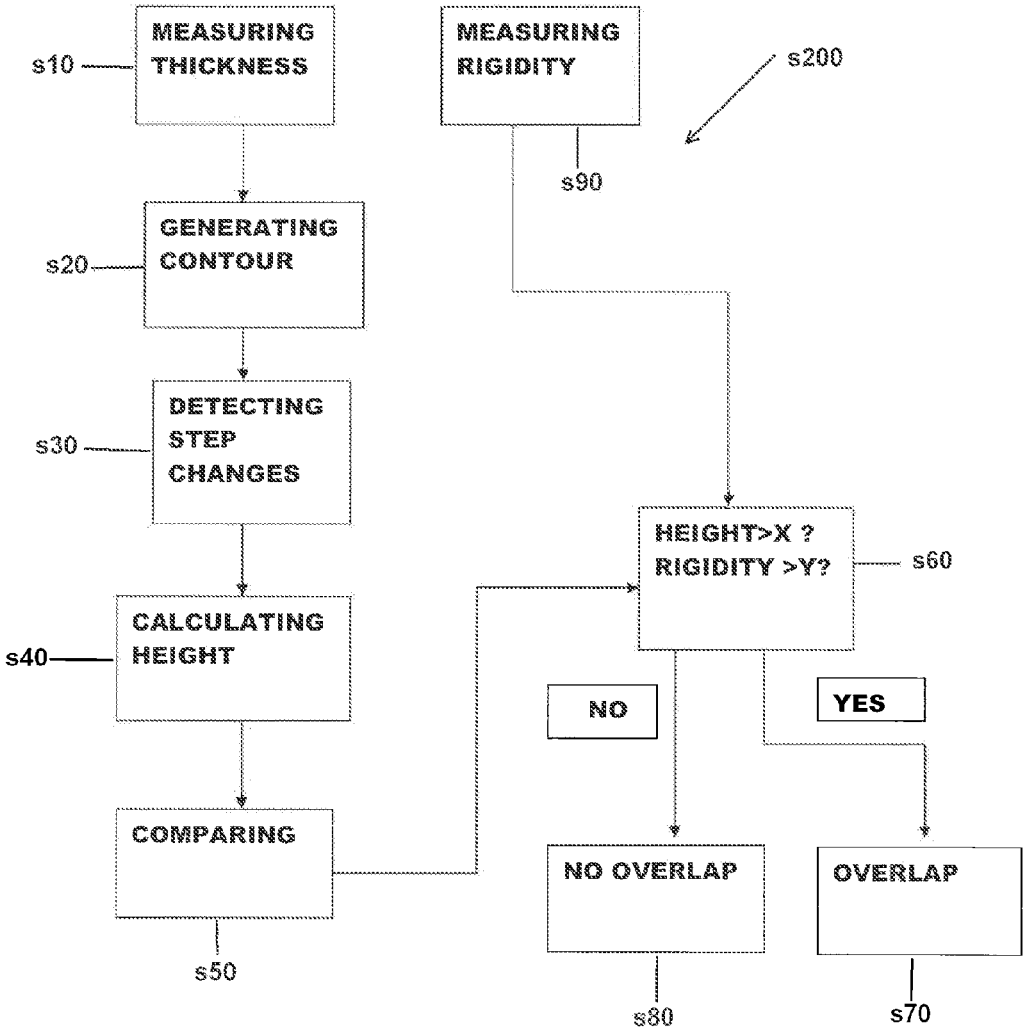

In FIG. 9B, it is illustrated a detection process s200 that can be applied to detect an item condition, such as, a double or multiple feeds condition (overlapped items) using any of the systems as disclosed in the embodiments of FIGS. 1-8, where in addition to thickness detection, rigidity detection is also performed on the moving item. The process s200 can also be stored in a non-transitory computer readable medium, such as disks, CD-ROMs, etc. and executed using a computer processing system including and any software and hardware modules necessary for execution of the process in a particular application. A sequence of programmed instructions is embodied upon the computer-readable storage medium for handling overlapped items in an item sorting system so that when a computer processing system executes the sequence of programmed instructions embodied on the computer-readable storage medium it causes the computer processing system to perform the steps of: measuring a thickness of the item at a plurality of locations along a dimension of the item, detecting variations in the measured thickness, measuring differences between the variations, the differences indicating step changes between discrete levels of thicknesses, comparing the step changes with a predetermined value, and determining a double feed condition indicative of two or more overlapped items when a step change is greater than the predetermined value.

A detection device is continuously measuring a thickness of an item in s10 along various points along a dimension of the item, the item being transported (transferred, conveyed) on a conveying device through a measuring section. A thickness contour generation follows in step s20 in which a contour is generated based on the variations in the thickness of the item across its dimension. Based on the generated contour, step changes or locations where there is a change in the thickness of the item, are detected in step s30. The height of each of the detected step change is calculated in s40 and the measured heights are compared to a previously set value (X) in s50. During the thickness measurement step s1, the item rigidity is also measured (s90). In s60 the result of the comparison in step s50 is combined with a step of comparing the measured rigidity in s90 with a predetermined rigidity value (Y). Based on the combined comparison in s60, it is determined whether a double or multiple feeds condition exists. If the height of a step change is greater than the predetermined value (X) and the rigidity is greater than the predetermined value (Y) then there is an overlap condition present, namely, the item contains overlapped pieces (s70), whereas if the height of a step change is less than the predetermined value (X) and the rigidity is less than the predetermined value (Y), it is concluded that there is no overlap and therefore no double feed condition (s80). The number of step changes having a height greater than the predetermined value (X) and a greater rigidity than the predetermined value (Y) represents the number of items which are overlapped.

It is therefore, apparent that there is provided, in accordance with the present disclosure, a system and method for detecting overlapped items in a sequence of items. Many alternatives, modifications, and variations are enabled by the present disclosure. Features of the disclosed embodiments can be combined, rearranged, omitted, etc. within the scope of the invention to produce additional embodiments.

Furthermore, certain features of the disclosed embodiments may sometimes be used to advantage without a corresponding use of other features. Accordingly, Applicant intends to embrace all such alternatives, modifications, equivalents, and variations that are within the spirit and scope of the present disclosure.

While embodiments and applications of this invention have been shown and described, it would be apparent to those skilled in the art that many more modifications are possible without departing from the inventive concepts herein. The invention is not limited to the description of the embodiments contained herein, but rather is defined by the claims appended hereto and their equivalents.

What is claimed is:

1. An overlap detection system for detecting overlapped items in a sequence of items transported along a conveyance path, the system comprising:

a thickness measuring device positioned adjacent the conveyance path to measure a thickness of an item at a plurality of locations along a length of the item; and a processing device configured to determine whether a double feed condition is present based on the thickness measurement, wherein, the processing device is further configured to:

generate a thickness outline of the item based on the measured thicknesses;

generate one or more edge levels corresponding to differences between adjacent thickness levels in the thickness outline;

compare each edge level with a predetermined value; and determine whether a double feed condition is present based on the comparison, wherein a double feed condition is determined to be present when an edge level is greater than the predetermined value, and wherein a number of overlapped items corresponds with a number of edge levels which are greater than the predetermined value.

2. The system of claim 1, wherein the items in the sequence of items include one or more flat objects that are completely or partially overlapped and which have same or different shapes, sizes, dimensions, colors, and/or thicknesses.

3. The system of claim 2, wherein the flat objects include mail pieces, shingles, and/or plates.

4. The system of claim 1, wherein the processing device further includes:

an outline extraction device for generating the thickness outline from data representing different thicknesses measured by the thickness measuring device;

an analyzing device for analyzing the extracted thickness outline to determine discrete levels of thicknesses and to determine transition edges between areas of adjacent discrete thickness levels;

a calculating device for calculating a height of each transition edge to generate the edge levels; and an evaluation device for evaluating each edge level to determine the presence of overlapped items, wherein the evaluating device further includes a comparing device to compare each edge level with the predetermined value.

5. The system of claim 1, further comprising a rigidity measuring device to measure a rigidity of the item in the sequence of items, wherein the processing device is further configured to compare the measured rigidity with a predetermined rigidity value and determine whether the item is an overlapped item based on the edge level and the rigidity comparisons.

6. The system of claim 1, further comprising:

a transition section in the conveyance path for changing a direction of movement of the item along the conveyance path so as to shift overlapped items relative to each other, the changing of the direction of movement including transporting the item along a transition section in the conveyance path.

7. The system of claim 6, wherein the transition section includes any one of a bent portion, a curved portion, and an edge portion in the conveyance path.

8. The system of claim 7, further comprising a rigidity or stiffness measuring device for measuring a rigidity of the item as it moves along the transition section, wherein the processing device determines whether the item is an overlapped item based on the thickness and the rigidity measurements.

9. The system of claim 8, wherein measuring the rigidity includes measuring a deflection of the item at a predetermined position.

* * * * *